United States Patent [19]

Kessler

[11] 3,955,220

[45] May 11, 1976

[54] SWIMMING POOL CONSTRUCTION

[76] Inventor: Frank L. Kessler, 17 Vassar Road, Broomall, Pa. 19008

[22] Filed: Nov. 26, 1973

[21] Appl. No.: 418,917

[52] U.S. Cl. ..... 4/172.19; 4/172.21

[51] Int. Cl.[2] ..... E04H 3/16; E04H 3/18

[58] Field of Search ..... 4/172, 172.19, 172.12, 4/172.21

[56] References Cited

UNITED STATES PATENTS

| | | | |
|---|---|---|---|
| 3,225,362 | 12/1965 | Barrera | 4/172.19 |
| 3,233,251 | 2/1966 | Barrera | 4/172.19 |
| 3,287,740 | 11/1966 | Langer | 4/172.12 |
| 3,344,440 | 10/1967 | Langer | 4/172.12 |
| 3,354,473 | 11/1967 | Schwarz | 4/172 |
| 3,409,916 | 11/1968 | Billig et al. | 4/172.19 |
| 3,793,651 | 2/1974 | Pitti et al. | 4/172.19 |
| 3,801,993 | 4/1974 | Stalder | 4/172.19 |

*Primary Examiner*—Henry K. Artis
*Attorney, Agent, or Firm*—Jay M. Cantor

[57] ABSTRACT

The disclosure relates to swimming pools having a sheet metal exterior wall of substantially continuous oval or circular shape having a liner attached thereto for retaining water for the pool. The liner is secured to the pool wall area by means of an S-shaped bead receiver positioned over the top surface of the wall and held in place by means of a top clip which is attached to spaced uprights about the pool wall, the top clip having a substantially U-shaped portion of slightly larger width than the portion of the bead receiver overlapping the top surface of the wall. In this manner, the bead receiver is locked in position when the top clip is secured to an upright. The bead of the liner can now be positioned into the other half of the S-shaped head receiver after completion of assembly of the pool. The liner can also be removed and replaced without disassembling the pool as was required by the prior art.

4 Claims, 4 Drawing Figures

SWIMMING POOL CONSTRUCTION

This invention relates to circular and oval swimming pools having sheet metal walls, and, more specifically, to such swimming pool wherein the water retaining liner can be easily installed and removed without the necessity of disassembling the swimming pool.

Circular swimming pools are normally assembled utilizing sheet metal walls, such as steel or aluminum. The walls of the circular swimming pool provide essentially no lateral support to the pool liner because the water in the liner tends to form in a circle. The major force is downward on the liner itself. Oval shaped pools have the same property as circular pools in their curved areas and require bracing only in the straight wall regions. For this reason, prior art circular and oval shaped swimming pools have been formed by draping the water retaining liner, usually formed from a vinyl material, over the top of the sheet walls, the liner being secured in place by a liner interlock positioned over the liner with a wall channel being secured over the interlock and held in place by a top clip secured to uprights spaced about the wall and providing support to the wall, if necessary. A coping, deck or the like is then positioned over and secured to the top clip with subsequent rails, etc., if desired, also secured to the top clip and/or coping or deck. After completion of the pool, the excess liner was then trimmed for aesthetic purposes. While this procedure provides desirable circular and oval shaped swimming pools, it is apparent that the vinyl liner often requires replacement due to wear or damage, this requiring that the pool be completely dismantled at great cost.

On round pools or in the curved portions of oval pools, the coping at these locations is in the form of a chord of a circle, the coping being formed in several straight chord sections. Because the coping is straight and the water in the pool tends to take a circular form, when the bead of a liner is placed into the bead receiving groove on the coping, there is a large gap between the liner which tends to be circular and the center of a coping section which is straight. For this reason, there is little if any support for the liner in those regions where there is a gap between the liner and the pool wall. This permits damage to the liner in these gap regions due to kicking or the like at these points. In addition, since the liner tends to be circular at its bottom portion and in the shape of a series of chords at its top portion the pool wall tends to be deflected and can easily buckle. It is therefore necessary that the pool liner be supported by the pool wall at all points.

In accordance with the present invention, the above noted problems of the prior art are overcome and there is provided a circular and oval shaped swimming pool wherein a water retaining liner is easily installed and removed without the necessity of disassembling the pool. Briefly, this is accomplished by attaching the liner to the pool wall area by means of an S-shaped bead receiver positioned over the top surface of the wall and held in place by means of a top clip which is attached to spaced uprights about the pool wall, the top clip having a substantially U-shaped portion of slightly larger width than the portion of the bead receiver overlapping the top surface of the wall. In this manner, the bead receiver is locked in position when the top clip is secured to an upright. The bead of the liner can now be positioned into the other half of the S-shaped bead receiver after completion of assembly of the pool. The liner can also be removed and replaced without disassembling the pool as was required by the prior art.

It is therefore an object of this invention to provide circular and oval shaped swimming pools wherein water retaining liners can be installed and removed without disassembling the pool.

It is a further object of this invention to provide circular and oval shaped swimming pools having a bead receiver locked on the pool wall for receiving the bead of a water retaining liner.

It is a still further object of this invention to provide a substantially S-shaped member for receiving a bead of a beaded water retaining liner while being secured over the upper edge of a swimming pool wall.

The above objects and still further objects of the invention will become immediately apparent to those skilled in the art after consideration of the following preferred embodiment thereof, which is provided by way of example and not by way of limitation, wherein.

Figure 1:
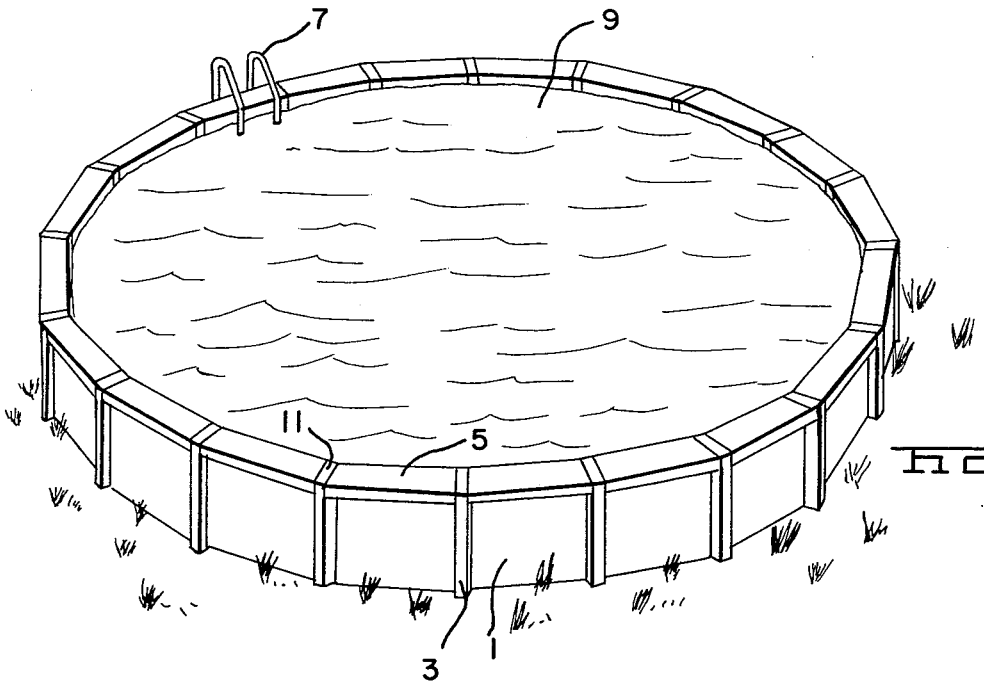
FIG. 1 is a view in elevation of a typical circular swimming pool.

Referring now to FIG. 1, there is shown a typical circular swimming pool having a side wall 1 which can be of sheet metal such as steel or aluminum or plastic and which is a continuous sheet which can be formed from a single sheet member or plural sheets secured together. A plurality of uprights 3 are secured in a tie strap (not shown) positioned on the ground with a bottom rail (not shown) abutting the uprights and secured in the bottom rail. The tie strap and bottom rail form no part of the invention and are utilized in prior art swimming pools. A coping 5 is secured over the wall 1 with coping cover 11 as will be explained in more detail hereinbelow. The coping can be wide enough to form a walkway or deck either alone or in conjunction with other members secured adjacent thereto. Also, a rail can be secured to the coping if desired. A ladder 7 is also provided for entry and exit from the pool. The liner 9 is secured to the pool wall as will be explained hereinbelow.

Figure 2:
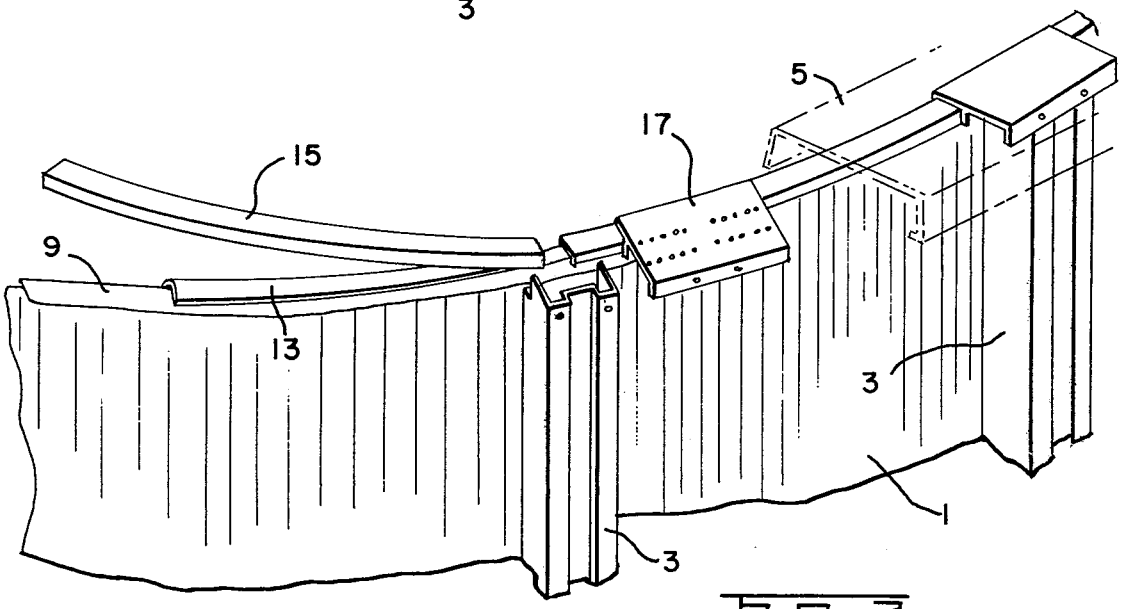
FIG. 2 is a view of a partially assembled circular swimming pool in accordance with the prior art.
Figure 3:
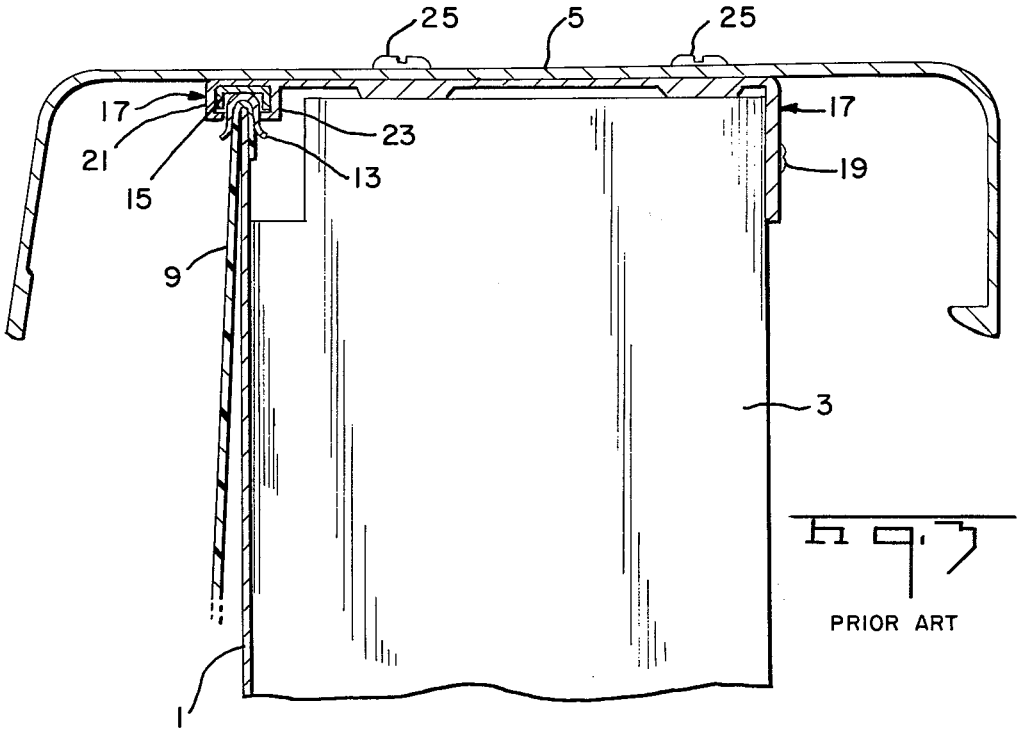
Fig. 3 PRIOR ART
FIG. 3 is a cross-section of an assembled swimming pool in accordance with the prior art.

Referring now to FIGS. 2 and 3 there is shown a pool assembly in accordance with the prior art. The pool includes the side wall 1 against which is positioned the uprights 3. The liner 9 is draped over the wall 1 and is secured to the top edge of the wall by a liner interlock 13. A wall channel 15 is positioned over the liner interlock 13 and secured in place by a top clip 17 positioned over each upright 3 and secured to each upright by bolts or screws 19. The top clip 17 includes a pair of flanges 21 and 23 (FIG. 3) for locking the wall channel 15 therein. A coping 5 is secured to the top clips 17 by means of bolts or screws 25. Rails or the like can be secured to the coping 5, if desired.

It can be seen that the liner 9 can be removed solely by removing each of the liner interlock 9, the wall channel 13, the top clip 17, the coping 5 and coping covers 11 as well as any rails, stairs, etc., secured thereto. This is substantially a complete disassembly of the pool.

Figure 4:
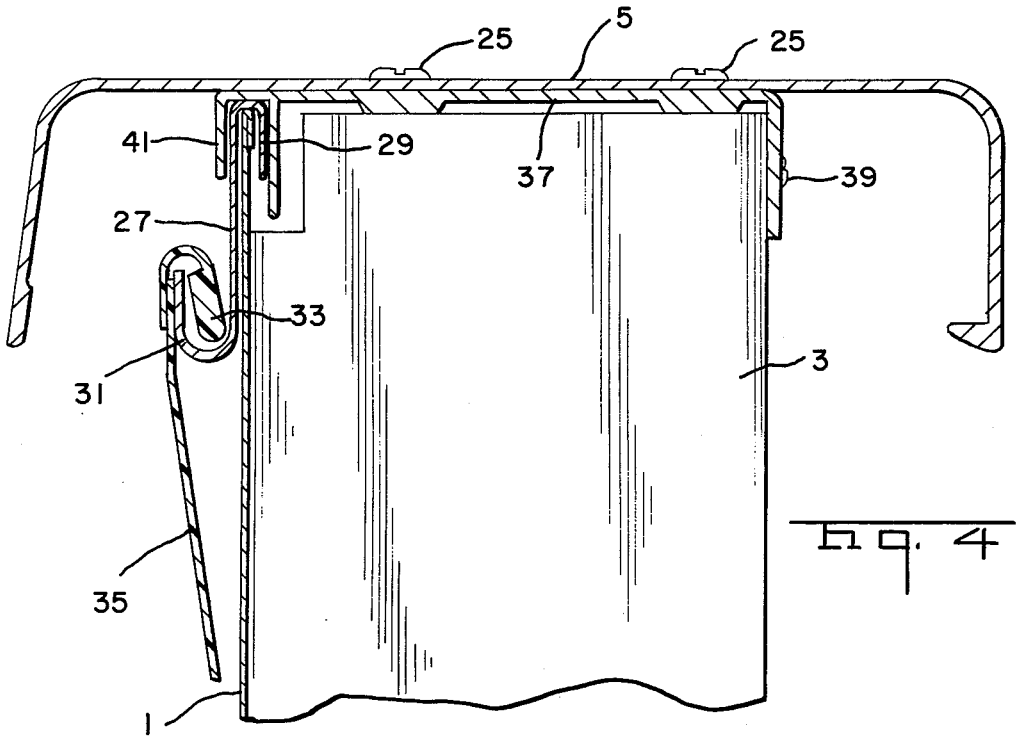
FIG. 4 is a cross-section of an assembled swimming pool in accordance with the present invention.

Referring now to FIG. 4, there is shown the present invention wherein a beaded liner is utilized and can be installed and removed without disassembling the pool.

The pool includes the same side wall 1, the embodiment of FIG. 4 showing a doubled over top edge. Also shown is the same set of uprights 3. The liner interlock 13 and wall channel 15 of the prior art have been eliminated and the top clip 17 has been slightly altered in shape. An S-shaped bead receiver 27 is utilized, one loop 29 of the S resting over the top edge of the wall 1 and the other loop 31 of the S receiving the bead 33 of the water retaining liner 35. The top clip 37 which is secured to the upright 3 by means of screws or bolts 39 includes a pair of flanges 41 and 43 which sit around the bead receiver loop 29 and lock it in place. A coping 5 as in FIG. 3 is also provided.

It can be seen that the bead 33 of the liner 35 is easily positioned into the loop 31 after pool assembly, the bead 33 locking into the loop 31 after the liner 35 has been filled with water due to the downward force on the liner 35 and bead 33 caused by the water. The liner is easily removed by removing the water, thereby removing the downward force and allowing the liner to be easily removed from the loop 31. It is therefore apparent that the liner can be easily assembled and removed in accordance with the present invention and without pool disassembly.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. In an above ground swimming pool having a substantially continuous wall forming an enclosure and a flexible lining for said wall having an upper edge bead, removable liner securing means within the enclosure having a wall member one end of which is looped over the upper edge of the swimming pool wall and extending thereabout, the other end of said securing means being bent upwardly to form with the wall member thereof a channel opening upwardly and parallel to the swimming pool wall for receiving the edge head of said liner, and means for releasably locking said liner securing means to said swimming pool wall at the upper end thereof.

2. In a swimming pool as set forth in claim 1 wherein said means for locking includes top clips spaced about said top edge, each said top clip having a pair of flanges extending around the upper end of said liner securing means.

3. In a swimming pool as set forth in claim 2 further including plural spaced uprights stationed about and adjacent waid wall, said means for locking said liner securing means each being secured to one of said uprights.

4. In a swimming pool as set forth in claim 1 further including plural spaced uprights stationed about and adjacent said wall, said means for locking said liner securing means each being secured to one of said uprights.

* * * * *